US006527300B1

(12) United States Patent
Moss

(10) Patent No.: US 6,527,300 B1
(45) Date of Patent: Mar. 4, 2003

(54) HOLDING DEVICE FOR A BOOK OR BINDER

(76) Inventor: James W. Moss, 12311 Taylorsville Rd., Louisville, KY (US) 40299

( * ) Notice: Subject to any disclaimer, the term of this patent is extended or adjusted under 35 U.S.C. 154(b) by 0 days.

(21) Appl. No.: 10/022,657

(22) Filed: Dec. 17, 2001

(51) Int. Cl.[7] ..... A42D 3/00

(52) U.S. Cl. ..... 281/36; 24/67 R; 206/472; 281/15.1; 281/45; 402/4

(58) Field of Search ..... 281/15.1, 29, 35, 281/36, 45, 48, 51; 402/4, 80 R; 206/472; 24/67 R, 67.5

(56) References Cited

U.S. PATENT DOCUMENTS 4,988,229 A * 1/1991 Ramsey, III ..... 402/4
5,246,251 A * 9/1993 Evans ..... 281/42
5,417,456 A 5/1995 Laubacher
5,421,616 A * 6/1995 Laubacher ..... 281/45
5,456,497 A * 10/1995 Ross, Jr. ..... 281/42
D414,211 S * 9/1999 Williams ..... D19/91

* cited by examiner

*Primary Examiner*—A. L. Wellington
*Assistant Examiner*—Monica Carter
(74) *Attorney, Agent, or Firm*—Charles G. Lamb; Middleton Reutlinger

(57) ABSTRACT

A device that aids in the holding of a book or binder is fully adjustable to the hand size of the holder by parting and remating of hook and loop fastening strips attached to U-shaped clips, the U-shaped clips being placed at the top and bottom of the outside surface of the backbone or spine of a book or binder.

8 Claims, 1 Drawing Sheet

HOLDING DEVICE FOR A BOOK OR BINDER

BACKGROUND OF THE INVENTION

The present invention relates to a holding device for a book, binder, notebook, or the like, and more particularly relates to a holding device for holding a book, binder, or the like that can be comfortably held in the hand for an extended period of time.

Devices are known for assisting in the holding of a book, in making a sales presentation, reading from a book or singing from a song book, wherein a platform, podium or other resting place for the book is not practical or desirable.

Balancing an open loose-leaf binder, book, or other read-from devices in one hand while turning pages to search for particular information or documents contained in the book or binder or the like, can be difficult and may be particularly frustrating. Balancing, rather than firmly holding a book or the like for extended periods of time can also be tiring and conducive to risk fatigue. Particularly, when a person is singing in a choir or other choral group, the singer holds the music book or hymnal between the fingers of one hand and after an extended period of time it is common for cramps to develop in the hands and therefore the holding of the song book or hymnal becomes very tedious to hold. U.S. Pat. No. 5,417,456 to Laubacher teaches a book holding device comprised of the fabrication of several materials, such as an elastic band loop, covered with terry cloth attached to a loop type fastener. This loop type fastener is mateable with a hook type fastener that has been previously attached to the book or binder by means of a pressure sensitive adhesive. The elastic band loop is adapted to receive a hand for holding the book. However, one problem encountered with books and binders is that these books and binders, in many instances, contain vinyl or polyethylene sheeting which constantly exudes a resin which by its very nature affects adhesive attachment in a negative way. In this case the integrity of the adhesive is compromised by the exuded resins thereby causing a separation or release where a tight bond is needed. Moreover, the pressure of the finger and thumb tip on the surface of the binder creates a reverse pressure on the back of the hand to the added pressure causing the adhesive to pull away from the vinyl, polyethylene sheeting, or other types of surfaces.

SUMMARY OF THE INVENTION

It is an object of the present invention to provide a holding device for a book or binder that can be held in an individual's hand for long periods of time without causing cramps or like in the hands.

It is another object of the present invention to provide a holding device for books, binders, or notebooks, or the like, which is easy to assembly onto the spine of a book which is adapted to receive the hand of a user.

It is also an object of the present invention to provide a holding device for a book or binder which provides a comfortable way for the holder of the book or binder to hold the book or binder in either hand.

It is even another object of the present invention to provide a holding device for a book or binder which utilizes hook and loop type fasteners which provide for a removably attachable book holding device.

It is even a further object of the present invention to provide a book holding device which includes hook and loop type fasteners thereby providing a holding device capable for use with books or binders of various sizes.

It is even another object of the present invention to provide a device for holding a book or binder which is relatively inexpensive and easily changed from one book to another.

More particularly, the present invention provides a holding device for a book which includes first and second U-shaped clips having a back leg and a spaced front leg. Each of the U-shaped clips is provided with a strip of flexible material having one end attached to a front leg of the U-shaped clip and an opposed end with an adjustable fastening device thereon, the adjustable fastening devices on the opposed ends being mateable.

BRIEF DESCRIPTION OF THE DRAWINGS

A better understanding of the invention will be had upon reference to the following description in conjunction with the accompanying drawings in which like numerals refer to like parts therethrough the various views and wherein.

DETAILED DESCRIPTION OF THE PREFERRED EMBODIMENT

Figure 1:
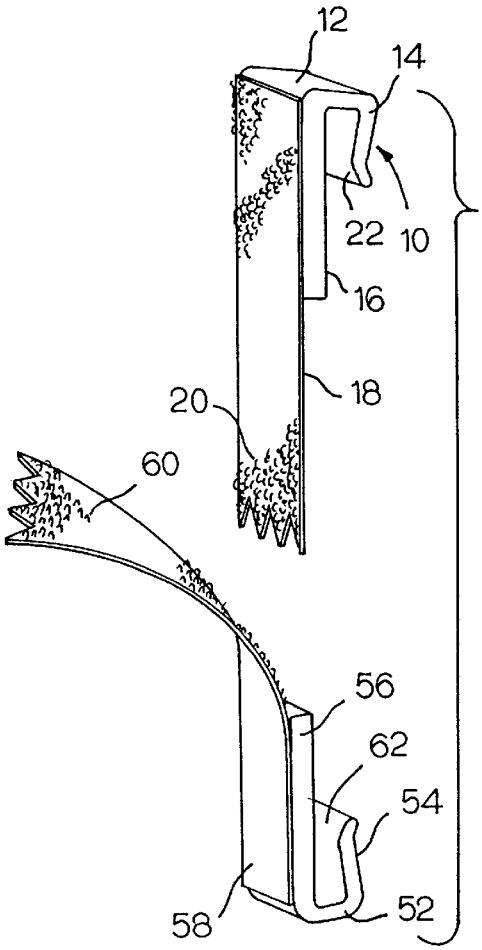
FIG. 1 is a perspective view of one preferred embodiment of the present invention.
Figure 2:
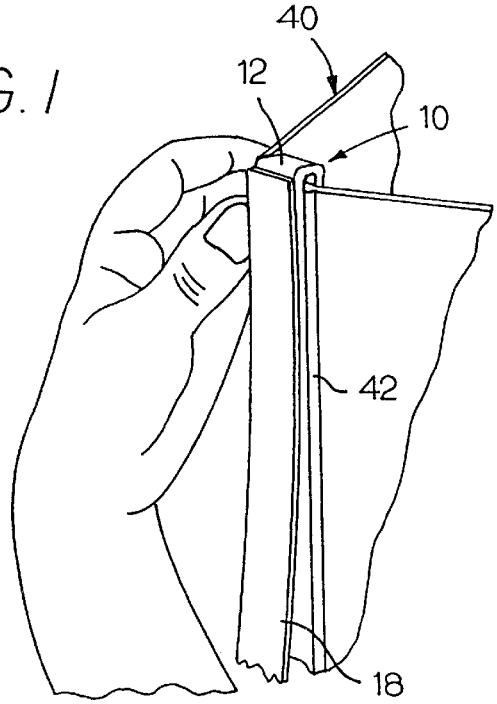
FIG. 2 is a perspective view showing the embodiment of FIG. 1 being attached to a book or binder; and, FIG. 3 is a perspective view of the embodiment of FIG. 1 shown in a use condition.
Figure 3:
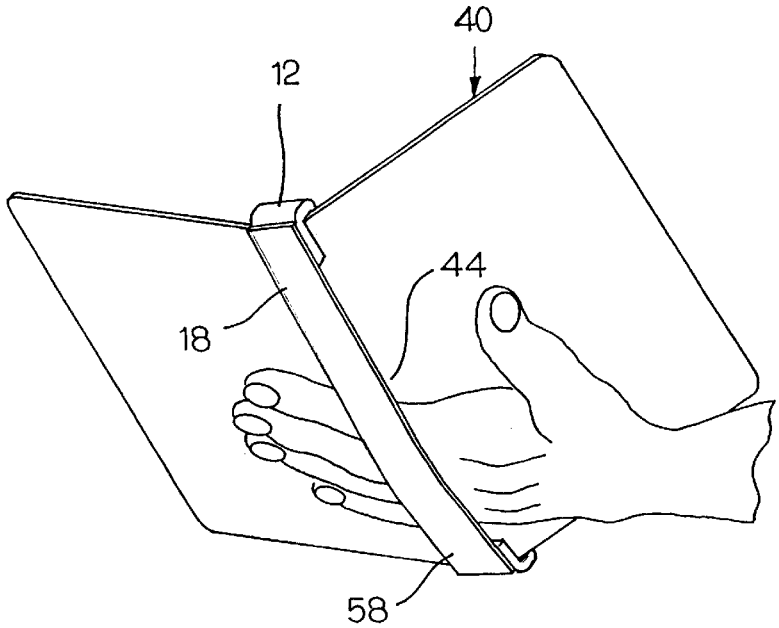

As shown in FIGS. 1–3, a book holding device 10 is provided with a pair of clips 12 and 52 for attaching to the spine or backbone 42 of a book or binder 40. The clips 12 and 52 are generally made of a resilient material, such as a plastic or a selected metal, such as aluminum, and are of generally U-shaped or J-shaped configuration with a back leg 14 and 54, respectively, and a front leg 16 and 56, respectively. To the front legs 16, 56 are attached straps or strips 18 and 58, respectively, of a fabric or other type flexible material which is attached at one end to the front legs 16, 56 of clips 12, 52. Strips 18 and 58 may be attached to the legs 16 and 56 by any conventional means, such as an adhesive, grommets, or the like. At the opposed ends of the strips 18 and 58 are adjustable mating fastening devices, as identified by the numerals 20 and 60, respectively. In a preferred embodiment the fasteners are made of hook and loop fasteners, such as VELCRO. Other fasteners may include buckle fastening devices well know for adjusting belt sizes as well as a hole-and-pin system which is well known for use on the back of ball caps for adjusting ball caps to various head sizes. Moreover, in a preferred embodiment the front legs 16, 56 are longer than the back legs 18, 54 thereby providing more surface area for attaching the straps 18 and 58 to the front legs. Also, in a preferred embodiment, the back legs 14 and 54 are of generally V-shaped construction or are provided with lip portions 22 and 62, respectively, which extend inwardly toward the front legs 16 and 56, respectively.

In the installation of the holding device 10 of the present invention, clips 12 and 52 are attached over the top and bottom outer edges of the backbone or spine 42 of a book or binder 40. Faces of the adjacent surfaces of the hook fastener 20 and the loop fastener 60 are then brought together to form a fully adjustable single strap support for the hand which is placed in the opening 44 defined by the straps 18, 58 and the backbone or spine 42.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A holding device for a book comprising:

first and second U-shaped clips having a back leg and a spaced front leg;

a first strip of flexible material having a first adjustable fastening device on one end of said first strip of flexible material, said first strip of flexible material having an opposed end attached to a front leg of said first U-shaped clip; and, a second strip of flexible material having a second adjustable fastening device mateable with said first adjustable fastening device on one end of said second strip of flexible material, said second strip of flexible material having an opposed end attached to said front leg of said second U-shaped clip.

2. The holding device of claim 1, said front legs of said U-shaped clips being longer than said back legs.

3. The holding device of claim 1, said first fastening device being a hook fastener and said second fastening device being a loop fastener.

4. The holding device of claim 1, said first and said second fastening devices being mateable hook and loop fasteners.

5. The holding device of claim 1, said back legs having a lip portion extending inwardly toward said front legs.

6. The holding device of claim 1, said clips being of a resilient material.

7. The holding device of claim 6, said resilient materials including plastics and metals.

8. The holding device of claim 1, said back legs being of generally V-shaped construction.

* * * * *